US007862971B2

(12) United States Patent
Moffat et al.

(10) Patent No.: US 7,862,971 B2
(45) Date of Patent: Jan. 4, 2011

(54) EMULSION AGGREGATION TONER COMPOSITION

(75) Inventors: Karen A. Moffat, Brantford (CA); Edward G. Zwartz, Mississauga (CA); T. Brian McAneney, Mississauga (CA); Fernando P. Yulo, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 447 days.

(21) Appl. No.: 11/669,623

(22) Filed: Jan. 31, 2007

(65) Prior Publication Data

US 2008/0182191 A1 Jul. 31, 2008

(51) Int. Cl.
*G03G 9/00* (2006.01)

(52) U.S. Cl. ..... 430/108.8; 430/109.3; 430/110.4; 430/124.1; 430/137.14; 399/252; 399/337

(58) Field of Classification Search ..... 430/108.8, 430/109.3, 110.4, 137.14, 124.1; 399/252, 399/337

See application file for complete search history.

(56) References Cited

U.S. PATENT DOCUMENTS

| | | | | |
|---|---|---|---|---|
| 5,409,557 | A | 4/1995 | Mammino et al. | |
| 5,487,707 | A | 1/1996 | Sharf et al. | |
| 5,514,436 | A | 5/1996 | Schlueter, Jr. et al. | |
| 6,099,673 | A | 8/2000 | Van Bennekom | |
| 6,447,974 | B1 | 9/2002 | Chen et al. | |
| 2004/0137357 | A1 * | 7/2004 | Bartel et al. | 430/137.14 |
| 2006/0121380 | A1 * | 6/2006 | Skorokhod et al. | 430/106.2 |
| 2006/0121384 | A1 * | 6/2006 | Patel et al. | 430/109.3 |

OTHER PUBLICATIONS

U.S. Appl. No. 11/272,720, filed Nov. 15, 2005 to Patel.

* cited by examiner

*Primary Examiner*—Mark A Chapman
(74) *Attorney, Agent, or Firm*—Oliff & Berridge, PLC

(57) ABSTRACT

An emulsion aggregation toner having toner particles comprising a gel latex, a high Tg latex and at least one wax, wherein the toner fuses at about 170° C. to about 220° C. at process speeds of from about 560 mm/s to about 870 mm/s, wherein the toner exhibits a crease fix property of less than about 60 and a half-toner rub fix property of less than about 0.15. The toner exhibits excellent half-tone rub fix performance and crease fix at high print speeds.

19 Claims, No Drawings

EMULSION AGGREGATION TONER COMPOSITION

BACKGROUND

The present disclosure generally relates to toners and their use in methods for forming and developing images of good quality, and in particular to emulsion aggregation toners with improved performance properties, such that the toner may exhibit excellent half-tone rub fix performance and crease fix at high print speeds.

REFERENCES

U.S. Publication No. 2006/0121384 to Patel, which is incorporated herein by reference in its entirety, discloses toner compositions and processes, such as emulsion aggregation toner processes, for preparing toner compositions comprising a resin substantially free of crosslinking, a crosslinked resin, a wax and a colorant.

U.S. patent application Ser. No. 11/272,720 to Patel et al., which is incorporated herein by reference in its entirety, is directed to toner compositions and processes, such as emulsion aggregation toner processes, for preparing toner compositions comprising a high molecular weight non-crosslinked resin such as having a weight average molecular weight of at least 50,000, a wax, and a colorant.

Emulsion aggregation (EA) toner particles are prepared by a process known in the art. Such a process includes the aggregation of various toner components from a starting latex of the components to form aggregated particles of a desired size, followed by the coalescence of the aggregated particles at elevated temperature. The components incorporated into the toner are chosen to provide all the necessary requirements for the final toner particle. A colorant may be added for color, a wax may be added to provide release from the fuser roll, for example for oil-less fuser systems, and a binder resin may be designed to provide a low minimum fusing temperature (MFT). Another key toner property, which may be controlled by the components of the EA toner particles, is fused image gloss. This feature is particularly important when designing EA toners for providing low gloss or matte images.

What is still desired is an emulsion aggregation toner with improved performance properties, including excellent half-tone rub fix performance and crease fix at high print speeds to provide excellent xerographic, fusing and image quality performance.

SUMMARY

These and other objects are accomplished by the toners described herein.

In embodiments, the toner is an emulsion aggregation toner having toner particles comprising a gel latex, a high Tg latex, a colorant and at least one wax, wherein the toner fuses at about 170° C. to about 220° C. at process speeds of from about 560 mm/s to about 870 mm/s, wherein when the fusing temperature of the toner is from about 170° C. to about 190° C. at process speeds of from about 560 mm/s to about 870 mm/s, the toner image exhibits a crease fix property of less than about 60 and a half-tone nib fix property as measured as the optical density of toner rubbed off onto a white cloth of less than about 0.15, wherein when the fusing temperature of the toner is from about 180° C. to about 200° C. at process speeds of from about 560 mm/s to about 870 mm/s, the toner image exhibits a crease fix property of less than about 60 and a half-tone rub fix property as measured as the optical density of toner rubbed off onto a white cloth of less than from about 0.15, and wherein when the fusing temperature of the toner is from about 185° C. to about 205° C. at process speeds of about 800 mm/s to about 870 mm/s, the toner image exhibits a crease fix property of less than about 40 and a half-tone rub fix property as measured as optical density of toner rubbed off onto a white cloth of less than about 0.15.

In embodiments, described is a process for forming an image comprising forming an electrostatic latent image on a photoconductive member, developing the electrostatic latent image to form a visible image by depositing toner on a surface of the photoconductive member, and transferring the visible image to a substrate and fixing the visible image to the substrate with a fuser member, wherein the toner comprises a gel latex, a colorant, a high Tg latex and at least one wax, and wherein the fixing occurs at from about 170° C. to about 195° C. at process speeds of from about 560 mm/s to about 870 mm/s, wherein the toner exhibits a crease fix property of less than about 60 and a half-toner rub fix property of less than about 0.15.

In embodiments, an electrophotographic image forming apparatus comprising a photoreceptor, a development system, a housing in association with the development system and containing a developer comprising a carrier and a toner, and a fuser member, wherein the toner includes toner particles comprising toner particles comprising a gel latex, a colorant, a high Tg latex and at least one wax, wherein the fuser member operates at a fusing temperature of from about 170° C. to about 195° C. at process speeds of from about 560 mm/s to about 870 mm/s, at which the toner image exhibits a crease fix property of less than about 60 and a half-tone rub fix property of less than about 0.15.

EMBODIMENTS

Emulsion aggregation toners should display certain fusing performance metrics to produce well fused images that provide superior image quality. The EA toner disclosed herein achieves such fusing performance metrics including, for example, excellent crease fix performance and half-tone rub fix performance at high print speeds.

In general, an EA toner may display an advantage in crease fix performance where the minimum fusing temperature (MFT) required to fuse the EA toner can be reduced. However, at the same time, the half-tone rub fix metric must also be met at the same fusing temperature, which is not always possible. For both of these requirements to be met, a higher MFT must be used. However, a higher MFT typically leads to problems occurring with the fuser. That is, such comparative toners that require a higher MFT in order to simultaneously display acceptable half-tone rub fix and crease fix thus exhibit a higher unscheduled maintenance rate (UMR).

The present EA toner provides many advantages in xerographic, fusing and image quality performance over conventional toners having an impact on the fuser UMR. The toner provides improvement in crease fix and half-tone rub fix performance at higher process speeds.

The present EA toner displays improved crease fix and half-tone rub fix performance at fusing temperatures from about 170° C. to about 220° C. such as from about 180° C. to about 200° C. The toner displays such desired fusing temperatures while running at a process speed of from about 560 mm/s to about 870 mm/s. As the process speed increases, for example from about 560 to about 745 mm/s or from about 745 mm/s to about 870 mm/s, the unexpected advantage in crease fix performance and half-tone rub fix performance becomes even greater at the higher print speeds. When the fusing temperature of the toner is from about 170° C. to about 220° C. at process speeds of from about 560 mm/s to about 870 mm/s, the toner image may exhibit a crease fix property of less than about 60, such as less than about 40 and a half-tone rub fix property of less than about 0.15, such as less than about 0.12.

In embodiments, when the fusing temperature of the toner is from about 185° C. to about 205° C. at process speeds of about 800 mm/s to about 870 mm/s, the toner image exhibits a crease fix property of less than about 40 and a half-tone rub fix property as measured as optical density of toner rubbed off onto a white cloth of less than about 0.15. In further embodiments, the half-tone rub fix may be less than about 0.12.

The properties of the EA toner, including the size of the particles, the narrow distribution and low amount of additives, together provide for a development system that displays improved half-tone rub fix performance at high print speeds.

The EA toner disclosed herein comprises at least a gel latex, a colorant, a high glass transition temperature (Tg) latex, and a wax.

The toner particles disclosed herein include a high Tg latex. For example, the high Tg latex comprises latex comprising monomers, such as styrene, butyl acrylate, and beta-carboxyethylacrylate (beta-CEA) monomers prepared, for example, by emulsion polymerization in the presence of an initiator, a chain transfer agent (CTA), and surfactant.

Instead of beta-CEA, the high Tg latex may include any carboxyl acid containing monomer, such as maleic acid, citraconic acid, itaconic acid, alkenyl succinic acid, fumaric acid, mesaconic acid, maleic-acid anhydride, citraconic anhydride, itaconic-acid anhydride, alkenyl succinic-acid anhydride, maleic-acid methyl half ester, maleic-acid ethyl half ester, maleic-acid butyl half ester, citraconic-acid methyl half ester, citraconic-acid ethyl half ester, citraconic-acid butyl half ester, itaconic-acid methyl half ester, alkenyl succinic-acid methyl half ester, fumaric-acid methyl half ester, half ester of the partial saturation dibasic acid such as mesaconic acid methyl half ester, dimethyl maleic acid, the partial saturation dibasic acid ester such as dimethyl fumaric acid, acrylic acid, methacrylic acid, alpha like crotonic acid, cinnamon acid, beta-partial saturation acid, crotonic-acid anhydride, cinnamon acid anhydride, alkenyl malonic acid, a monomer which has an alkenyl glutaric acid, and alkenyl adipic acids.

In embodiments, the high Tg latex comprises styrene:butyl acrylate:beta-CEA wherein, for example, the high Tg latex monomers include from about 70 weight percent to about 90 weight percent styrene, from about 10 weight percent to about 30 weight percent butyl acrylate, and from about 0.05 weight percent to about 10 weight percent beta-CEA. In embodiments, the toner comprises high Tg latex in an amount of from about 50 weight percent to about 95 weight percent of the total weight of the toner described herein, such as 65 weight percent to about 80 of the total weight of the toner described herein. The latitude loading of the high Tg latex around about the centerline particle formulation may be about 71 weight percent±about 4 weight percent.

The high Tg latex disclosed herein that is substantially free of crosslinking and has a crosslinked density less than about 0.1 percent, such as less than about 0.05. As used herein "crosslink density" refers to the mole fraction of monomer units that are crosslinking points. For example, in a system where 1 of every 20 molecules is a divinylbenzene and 19 of every 20 molecules is a styrene, only 1 of 20 molecules would crosslink. Thus, in such a system, the crosslinked density would be 0.05.

The onset Tg (glass transition temperature) of the high Tg latex may be from about 53° C. to about 70° C., such as from about 53° C. to about 67° C. or from about 53° C. to about 65° C., or such as about 55° C.

The weight average molecular weight (Mw) of the high Tg latex may be from about 20,000 to about 60,000, such as from about 30,000 to about 40,000, or about 35,000.

The gel latex may be prepared from a high Tg latex, such as a latex comprising monomers of styrene, butyl acrylate, beta-CEA, divinylbenzene, a surfactant and an initiator. Instead of the beta-CEA, the gel latex may include a carboxyl acid containing monomer as described above. The gel latex may be prepared by emulsion polymerization.

In embodiments, the crosslinked density of the gel latex is from about 0.3 percent to about 40 percent, such as from about 0.3 percent to about 35 percent or from about 0.3 percent to about 30 percent crosslinked density.

In embodiments, the toner comprises gel latex in an amount of from about 3 weight percent to about 30 weight percent of the total weight of the toner described herein, such as about 5 weight percent to about 15 weight percent of the total weight of the toner described herein. The latitude of the gel latex around about the centerline particle formulation may be about 10 weight percent±about 2 weight percent.

Other latexes suitable for preparing the high Tg latex and the gel latex include styrene acrylates, styrene methacrylates, butadienes, isoprene, acrylonitrile, acrylic acid, methacrylic acid, beta-carboxy ethyl acrylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(stylene-butyl acrylate-methacrylic acid), poly(styrene-butyl acrylate-acrylonitrile), poly(styrene-butyl acrylate-acrylonitrile-acrylic acid), and the like. In embodiments, the resin or polymer is a styrene/butyl acrylate/beta-carboxyethylacrylate tertpolymer.

An initiator suitable for use in producing both the gel latex and the high Tg latex may be, for example, sodium, potassium or ammonium persulfate and may be present in with both the crosslinking starting monomers and non-crosslinking starting monomers in the range of from about 0.1 weight percent to about 5 weight percent, such as from about 0.3 weight percent to about 4 weight percent or from about 0.5 weight percent to about 3 weight percent of an initiator based upon the total weight of the monomers. In embodiments, the surfactant may be present in the range of from about 0.3 weight percent to about 10 weight percent, such as from about 0.5 weight percent to about 8 weight percent or from about 0.7 to about 5.0 weight percent of surfactant.

Both the gel latex and the high Tg latex may be produced by similar methods. However, in producing the high Tg latex, no divinylbenzene or similar crosslinking agent is used.

Examples of crosslinking agents suitable for making the gel latex include divinylbenzene, divinylnaphthalene, ethylene glycol diacrylate, 1,3-butylene-glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene-glycol #400 diacrylate, dipropylene glycol diacrylate, and polyoxyethylene (2)-2,2-bis(4-hydroxyphenyl)propane diacrylate. The gel latex and high Tg latex may be made by any suitable method. One example of a suitable method is described below for illustration.

First, a surfactant solution is prepared by combining a surfactant with water. Surfactants suitable for use herein may be anionic, cationic or nonionic surfactants in effective amounts of, for example, from about 0.01 to about 15, or from about 0.01 to about 5 weight percent of the reaction mixture.

Anionic surfactants include sodium dodecylsulfate (SDS), sodium dodecylbenzene sulfonate, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SCT™ obtained from Kao, and the like.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, SANISOL B-50 available from Kao Corp., which consists primarily of benzyl dimethyl alkonium chloride, and the like.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and mixtures thereof.

In a separate container, an initiator solution is prepared. Examples of initiators for the preparation of the latex include water soluble initiators, such as ammonium and potassium persulfates in suitable amounts, such as from about 0.1 to about 8 weight percent, and more specifically, in the range of from about 0.2 to about 5 weight percent. The latex includes both the initial latex and the added delayed latex wherein the delayed latex refers, for example, to the latex portion which is added to the already preformed aggregates in the size range of about 4 to about 6.5 μm, as described below.

In yet another container, a monomer emulsion is prepared by mixing the monomer components of the latex, such as styrene, butyl acrylate, beta-CEA, optionally divinylbenzene if producing the gel latex, and surfactant. In one embodiment, the styrene, butyl acrylate, and/or beta-CEA are olefinic monomers.

Once the preparation of the monomer emulsion is complete, a small portion, for example, about 0.5 to about 5 percent of the emulsion, may be slowly fed into a reactor containing the surfactant solution. The initiator solution may be then slowly added into the reactor. After about 15 to about 45 minutes, the remainder of the emulsion is added into the reactor.

After about 1 to about 2 hours, but before all of the emulsion is added to the reactor, 1-dodecanethiol or carbon tetrabromide (charge transfer agents that control/limit the length of the polymer chains) is added to the emulsion. In embodiments, the charge transfer agent may be used in effective amounts of, for example, from about 0.05 weight percent to about 15 weight percent of the starting monomers, such as from about 0.1 weight percent to about 13 weight percent or from about 0.1 weight percent to about 10 weight percent of the starting monomers. The emulsion is continued to be added into the reactor.

The monomers may be polymerized under starve fed conditions as referred to in U.S. Pat. No. 6,447,974, incorporated by reference herein in its entirety, to provide latex resin particles having a diameter in the range of from about 20 nanometers to about 500 nanometers, such as from about 75 nanometers to about 400 nanometers or from about 100 to about 300 nanometers.

In embodiments, the toner includes a wax. Examples of waxes suitable for use herein include aliphatic waxes such as hydrocarbon waxes having about 1 carbon atom to about 30 carbon atoms, such as from about 1 carbon atom to about 30 carbon atoms or from about 1 carbon atom to about 25 carbon atoms, polyethylene, polypropylene or mixtures thereof.

More specific examples of waxes suitable for use herein include polypropylene and polyethylene waxes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. Commercially available polyethylenes possess, it is believed, a number-average molecular weight (Mn) of about 1,000 to about 5,000, and commercially available polypropylenes are believed to possess a number-average molecular weight of about 4,000 to about 10,000. Examples of functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, and POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson Wax.

In embodiments, the wax comprises a wax in the form of a dispersion comprising, for example, a wax having a particle diameter of from about 100 nanometers to about 500 nanometers, water, and an anionic surfactant. In embodiments, the wax is included in amounts such as from about 2 to about 40 weight percent. The latitude of the wax around about the centerline toner particle formulation may be about 11-weight percent±about 1 weight percent. In embodiments, the wax comprises polyethylene wax particles, such as POLYWAX 850, POLYWAX 725, POLYWAX 750 and POLYWAX 655, commercially available from Baker Petrolite, having a particle diameter in the range of about 100 to about 500 nanometers.

In embodiments, colorants may be included in the particles, for example where it is desired to use the particles as toner particles. The colorant may be pigment, dye, mixtures of pigment and dye, mixtures of pigments, mixtures of dyes, and the like.

In embodiments, the colorant comprises a pigment, a dye, mixtures thereof, carbon black, magnetite, black, cyan, magenta, yellow, red, green, blue, brown, mixtures thereof, in an amount of about 1 weight percent to about 25 weight percent by weight based upon the total weight of the toner composition, such as from about 2 weight percent to about 20 weight percent or from about 5 weigh percent to about 15 weight percent based upon the total weight of the toner composition. In embodiments, the latitude of colorant around about a centerline particle formulation is about 10 weight percent±about 1 weight percent based upon the total weight of the toner composition. It is to be understood that other useful colorants will become readily apparent to one of skill in the art based on the present disclosure.

Examples of suitable colorants for making toners include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet LA300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D11351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites. BAYFERROX 8600, 8610; Northern Pigments magnetites. NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICO BLACK and cyan components may also be selected as pigments.

External additives may be added to the toner particle surface by any suitable procedure such as those well known in the art. For example, suitable surface additives that may be used are one or more of $SiO_2$, metal oxides such as, for example, $TiO_2$ and aluminum oxide, and a lubricating agent such as, for example, a metal salt of a fatty acid (for example, zinc stearate (ZnSt), calcium stearate) or long chain alcohols such as UNILIN 700. $SiO_2$ and $TiO_2$ may be surface treated with compounds including DTMS (dodecyltrimethoxysilane) or HMDS (hexamethyldisilazane). Examples of these additives are a silica coated with a mixture of HMDS and aminopropyltriethoxysilane; a silica coated with PDMS (polydimethylsiloxane); a silica coated with octamethylcyclotetrasiloxane; a silica coated with dimethyldichlorosilane; DTMS silica, obtained from Cabot Corporation, comprised of a fumed silica, for example silicon dioxide core L90 coated with DTMS; silica coated with an amino functionalized organopolysiloxane; X24 sol-gel silica available from Shin-Etsu Chemical Co., Ltd.; TS530 from Cabot Corporation, Cab-O-Sil Division, a treated fumed silica; titania comprised of a crystalline titanium dioxide core coated with DTMS; and titania comprised of a crystalline titanium dioxide core coated with DTMS. The titania may also be untreated, for example P-25 from Nippon Aerosil Co., Ltd. Zinc stearate may also be used as an external additive, the zinc stearate providing lubricating properties. Zinc stearate provides developer conductivity and tribo enhancement, both due to its lubricating nature. In addition, zinc stearate can enable higher toner charge and charge stability by increasing the number of contacts between toner and carrier particles. Calcium stearate and magnesium stearate provide similar functions. Most preferred is a commercially available zinc stearate known as ZINC STEARATE L, obtained from Ferro Corporation.

The toner particles may be made by any known emulsion/aggregation process. An example of such a process suitable for use herein includes forming a mixture of the high Tg latex, the gel latex, wax and colorant, and deionized water in a vessel.

The mixture is then stirred using a homogenizer until homogenized and then transferred to a reactor where the homogenized mixture is heated to a temperature of, for example, about 50° C. and held at such temperature for a period of time to permit aggregation of toner particles to the desired size. Once the desired size of aggregated toner particles is achieved, the pH of the mixture is adjusted in order to inhibit further toner aggregation. The toner particles are further heated to a temperature of, for example, above about 90° C. and the pH lowered in order to enable the particles to coalesce and spherodize. The heater is then turned off and the reactor mixture allowed to cool to room temperature, at which point the aggregated and coalesced toner particles are recovered and optionally washed and dried.

Dilute solutions of flocculates or aggregating agents may be used to optimize particle aggregation time with as little fouling and coarse particle formation as possible. Examples of flocculates or aggregating agents may include polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ (available from Alkaril Chemical Company), SANIZOL™ (benzalkonium chloride) (available from Kao Chemicals), and the like, and mixtures thereof.

In embodiments, the flocculates or aggregating agents may be used in an amount of from about 0.01 weight percent to about 10 weight percent of the toner composition, such as from about 0.02 weight percent to about 5 weight percent or from about 0.05 weight percent to about 2 weight percent. For example, the latitude of flocculates or aggregating agents around about a centerline particle formulation is about 0.17 weight percent±about 0.02 weight percent based upon the total weight of the toner composition.

The size of the formed toner particles may be from about 3 μm to about 8 μm, such as a toner particle size of from about 4.5 μm to about 7 μm or from about 5 μm to about 6 μm.

The circularity may be determined using the known Malvern Sysmex Flow Particle Image Analyzer FPIA-2100. The circularity is a measure of the particles closeness to a perfect sphere. A circularity of 1.0 identifies a particle having the shape of a perfect circular sphere. The toner particles described herein may have a circularity of from about 0.94 to about 1.0, such as from about 0.95 to about 1.0.

The developed toner mass per unit area (TMA) suitable for the printed images from the toner described herein may be in the range of from about 0.35 mg/cm$^2$ to about 0.55 mg/cm$^2$, such as from about 0.4 mg/cm$^2$ to 0.5 about mg/cm$^2$ or from about 0.43 mg/cm$^2$ to about 0.47 mg/cm$^2$.

The onset Tg (glass transition temperature) of the toner particles may be from about 40° C. to about 65° C., such as from about 45° C. to about 60° C. or from about 50° C. to about 59° C.

The toner particles also preferably have a size such that the upper geometric standard deviation (GSDv) by volume for (D84/D50) is in the range of from about 1.15 to about 1.25, such as from about 1.18 to about 1.23. The particle diameters at which a cumulative percentage of 50% of the total toner particles are attained are defined as volume D50, which are from about 5.45 to about 5.88, such as from about 5.47 to about 5.85. The particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The upper GSDv value for the toner particles indicates that the toner particles are made to have a very narrow particle size distribution.

It may also be desirable to control the toner particle size and limit the amount of both fine and coarse toner particles in the toner. The toner particles may have a very narrow particle size distribution with a lower number ratio geometric standard deviation (GSDn), which is express as (number D50/number D16), of from about 1.20 to about 1.30, such as from about 1.22 to about 1.29.

In embodiments, a developer may be formed by mixing toner particles with one or more carrier particles. Carrier particles that can be selected for mixing with the toner include, for example, those carriers that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers comprised of nodular carrier beads of nickel, characterized by surfaces of reoccurring recesses and protrusions thereby providing particles with a relatively large external area. In embodiments, the carrier particles may have an average particle size of from, for example, about 20 to about 85 μm, such as from about 30 to about 60 μm or from about 35 to about 50 μm.

In an image forming process, an image forming device is used to form a print, typically a copy of an original image. An image forming device imaging member (for example, a photoconductive member) including a photoconductive insulating layer on a conductive layer, is imaged by first uniformly electrostatically charging the surface of the photoconductive insulating layer. The member is then exposed to a pattern of activating electromagnetic radiation, for example light, which selectively dissipates the charge in the illuminated areas of the photoconductive insulating layer while leaving behind an electrostatic latent image in the non-illuminated areas. This electrostatic latent image may then be developed to form a visible image by depositing the toner particles, for example from a developer composition, on the surface of the photoconductive insulating layer. A development system suitable for use herein may be a conductive magnetic brush development system. In embodiments, a CMB developer can be used in various systems, for example a semiconductive magnetic brush development system, which uses a semiconductive carrier. Other suitable development systems include hybrid development systems, for example hybrid scavengeless development (HSD) and hybrid jumping development (HJD).

The resulting visible toner image can be transferred to a suitable image receiving substrate such as paper and the like.

To fix the toner to the image receiving substrate, such as a sheet of paper or transparency, hot roll fixing is commonly used. In this method, the image receiving substrate with the toner image thereon is transported between a heated fuser member and a pressure member with the image face contacting the fuser member. Upon contact with the heated fuser member, the toner melts and adheres to the image receiving medium, forming a fixed image. This fixing system is very advantageous in heat transfer efficiency and is especially suited for high speed electrophotographic processes.

The fuser member suitable for use herein comprises at least a substrate and an outer layer. Any suitable substrate can be selected for the fuser member. The fuser member substrate may be a roll, belt, flat surface, sheet, film, drelt (a cross between a drum or a roller), or other suitable shape used in the fixing of thermoplastic toner images to a suitable copy substrate. Typically, the fuser member is a roll made of a hollow cylindrical metal core, such as copper, aluminum, stainless steel, or certain plastic materials chosen to maintain rigidity and structural integrity, as well as being capable of having a polymeric material coated thereon and adhered firmly thereto. The supporting substrate may be a cylindrical sleeve, preferably with an outer fluoropolymeric layer of from about 1 to about 6 millimeters. In one embodiment, the core, which can be an aluminum or steel cylinder, is degreased with a solvent and cleaned with an abrasive cleaner prior to being primed with a primer, such as DOW CORNING® 1200, which can be sprayed, brushed, or dipped, followed by air drying under ambient conditions for thirty minutes and then baked at about 150° C. for about 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

When the fuser member is a belt, the substrate can be of any desired or suitable material, including plastics, such as ULTEM®, available from General Electric, ULTRAPEK®, available from BASF, PPS (polyphenylene sulfide) sold under the tradenames FORTRON®, available from Hoechst Celanese, RYTON R-4®, available from Phillips Petroleum, and SUPEC®, available from General Electric; PAI (polyamide imide), sold under the tradename TORLON® 7130, available from Amoco; polyketone (PK), sold under the tradename KADEL® E1230, available from Amoco; PI (polyimide); polyaramide; PEEK (polyether ether ketone), sold under the tradename PEEK 450GL30, available from Victrex; polyphthalamide sold under the tradename AMODEL®, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PFA (perfluoroalkoxy); FEP (fluorinated ethylene propylene); liquid crystalline resin (XYDAR®), available from Amoco; and the like, as well as mixtures thereof. These plastics can be filled with glass or other minerals to enhance their mechanical strength without changing their thermal properties. In embodiments, the plastic comprises a high temperature plastic with superior mechanical strength, such as polyphenylene sulfide, polyamide imide, polyimide, polyketone, polyphthalamide, polyether ether ketone, polyethersulfone, and polyetherimide. Suitable materials also include silicone rubbers. Examples of belt-configuration fuser members are disclosed in, for example, U.S. Pat. Nos. 5,487,707 and 5,514,436, the disclosures of each of which are totally incorporated herein by reference. A method for manufacturing reinforced seamless belts is disclosed in, for example, U.S. Pat. No. 5,409,557, the disclosure of which is totally incorporated herein by reference.

The fuser member may include an intermediate layer, which can be of any suitable or desired material. For example, the intermediate layer can comprise a silicone rubber of a thickness sufficient to form a conformable layer. Suitable silicone rubbers include room temperature vulcanization (RTV) silicone rubbers, high temperature vulcanization (HTV) silicone rubbers, and low temperature vulcanization (LTV) silicone rubbers. These rubbers are known and are readily available commercially such as SILASTIC® 735 black RTV and SILASTIC®732 RTV, both available from Dow Corning, and 106 RTV Silicone Rubber and 90 RTV Silicone Rubber, both available from General Electric. Other suitable silicone materials include the silanes, siloxanes (preferably polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers. The intermediate layer may have a thickness of from about 0.05 to about 10 millimeters, such from about 0.1 to about 5 millimeters or from about 1 to about 3 millimeters.

The layers of the fuser member can be coated on the fuser member substrate by any desired or suitable means, including normal spraying, dipping, and tumble spraying techniques. A flow coating apparatus as described in U.S. Pat. No. 6,408,753, the disclosure of which is totally incorporated herein by reference, can also be used to flow coat a series of fuser members. In embodiments, the polymers may be diluted with a solvent, such as an environmentally friendly solvent, prior to application to the fuser substrate. Alternative methods, however, can be used for coating layers, including methods described in U.S. Pat. No. 6,099,673, the disclosure of which is totally incorporated herein by reference.

The outer layer of the fuser member may comprise a fluoropolymer such as polytetrafluoroethylene (PTFE), fluorinated ethylenepropylene copolymer (FEP), polyfluoroalkoxy (PFA), perfluoroalkoxy polytetrafluoroethylene (PFA TEFLON®), ethylene chlorotrifluoro ethylene (ECTFE), ethylene tetrafluoroethylene (ETFE), polytetrafluoroethylene perfluoromethylvinylether copolymer (MFA), combinations thereof and the like.

In embodiments, the outer layer may further comprise at least one filler. Examples of fillers suitable for use herein include a metal filler, a metal oxide filler, a doped metal oxide filler, a carbon filler, a polymer filler, a ceramic filler, and mixtures thereof.

In embodiments, an optional adhesive layer may be located between the substrate and the intermediate layer. In further embodiments, the optional adhesive layer may be provided between the intermediate layer and the outer layer. The optional adhesive intermediate layer may be selected from, for example, epoxy resins and polysiloxanes.

The subject matter disclosed herein will now be further illustrated by way of the following examples. All parts and percentages are by weight unless otherwise indicated.

EXAMPLES

Latex Example 1

Preparation of Main Latex A

A latex emulsion comprised of polymer particles generated from the emulsion polymerization of styrene, n-butyl acrylate and beta-CEA was prepared as follows. A surfactant solution consisting of about 6.37 kilograms Dowfax 2A1 (anionic emulsifier) and about 4,096 kg deionized water was prepared by mixing for about 10 minutes in a stainless steel holding tank. The holding tank was then purged with nitrogen for about 5 minutes before being transferred into the reactor. The reactor was then continuously purged with nitrogen while being stirred at about 100 RPM. The reactor was then heated up to about 80° C. at a controlled rate, and held there.

Separately, about 64.5 kg of ammonium persulfate initiator was dissolved in about 359 kg of deionized water.

Separately, the monomer emulsion was prepared in the following manner. About 3,413.3 kg of styrene, about 891.0 kg of butyl acrylate and about 129.1 kg of beta-CEA, about 30.1 kg of 1-dodecanethiol, about 15.06 kg of decanediol diacrylate, about 85.1 kg of Dowfax 2A1 (anionic surfactant), and about 2048 kg of deionized water were mixed to form an emulsion. About 1% of the emulsion was then slowly fed into the reactor containing the aqueous surfactant phase at about 80° C. to form the "seeds" while being purged with nitrogen. The initiator solution was then slowly charged into the reactor and after about 10 minutes the remaining emulsion was continuously fed in using a metering pump at a rate of about 0.5%/min. After about 100 minutes, approximately half of the monomer emulsion had been added to the reactor.

At this time, about 36.18 kilograms of 1-dodecanethiol was stirred into the monomer emulsion, and the emulsion was continuously fed in at a rate of about 0.5%/min. Also, at this time, the reactor stirrer was increased to about 350 RPM. Once all the monomer emulsion was charged into the main reactor, the temperature was held at about 80° C. for about an additional 2 hours to complete the reaction. Full cooling was then applied and the reactor temperature was reduced to about 35° C.

The product was collected into a holding tank. After drying the latex, the molecular properties were Mw=34,700, Mn=11,800, Mz=81,000, molecular weight distribution (MWD)=2.94, onset Tg was 55.0° C. and latex particle size=205 nanometers.

Latex Example 2

Preparation of Gel Latex B

A latex emulsion comprised of polymer gel particles generated from the semi-continuous emulsion polymerization of styrene, n-butyl acrylate, divinylbenzene, and beta-CEA was prepared as follows.

A surfactant solution consisting of about 10.5 kilograms Tayca surfactant (anionic emulsifier) and about 7 kilograms deionized water was prepared by mixing in a stainless steel holding tank. The holding tank was then purged with nitrogen for about 5 minutes before about 30 percent of the surfactant solution was transferred into the reactor. About an additional 437.4 kilograms of deionized was added into the reactor. The reactor was then continuously purged with nitrogen while being stirred at about 300 RPM. The reactor was then heated up to about 76° C. at a controlled rate and held constant.

In a separate container, about 3.72 kilograms of ammonium persulfate initiator was dissolved in about 39.4 kilograms of deionized water.

Also, in a second separate container, the monomer emulsion was prepared in the following manner. About 142.2 kilograms of styrene, about 76.56 kilograms of n-butyl acrylate, about 6.56 kilograms of beta-CEA, and about 2.187 kilograms of about 55% grade divinylbenzene, about 12.25 kilograms of Tayca solution (anionic surfactant), and about 236.2 kilograms of deionized water were mixed to form an emulsion. The ratio of styrene monomer to n-butyl acrylate monomer by weight was about 65 to about 35 percent.

About 1.5 percent of the above emulsion is then slowly fed into the reactor containing the aqueous surfactant phase at about 76° C. to form the "seeds" while being purged with nitrogen. The initiator solution was then slowly charged into the reactor and after about 20 minutes the rest of the emulsion was continuously fed in using metering pumps.

Once all of the monomer emulsion was charged into the main reactor, the temperature was held at about 76° C. for about an additional 2 hours to complete the reaction. Full cooling was then applied and the reactor temperature was reduced to about 35° C. The product was collected into a holding tank after filtration through a 1 micron filter bag.

After drying a portion of the latex, the onset Tg was about 41.2° C. The average particle size of the latex as measured by Microtrac was about 44 nanometers, and residual monomer as measured by Gas Chromatography as less than about 50 ppm for styrene and less than about 100 ppm for n-butyl acrylate.

Example 3

Preparation of EA Toner with Optimized Particle Formulation

This particle formulation is a 20-gallon production scale. The particles were blended with surface additives and the EA toner was used in a fuser dwell time process speed study.

The EA particles were prepared by mixing together 9.8514 kilograms of Latex A having a solids loading of 41.57 weight %, 3.96774 kilograms of wax emulsion (POLYWAX 725®) having a solids loading of 31 weight %, 6.27635 kilograms of black pigment dispersion CAVITRON PD-K200 (REGAL 330) having a solids loading of 17.1 weight %, 4 kilograms of gel Latex B having a solids content of 25 weight % with 31.2582 kilograms of de-ionized water in a vessel while being stirred using an IKA ULTRA TURRAX® T50 homogenizer operating at 4,000 rpm. After 5 minutes of homogenizing, slow controlled addition of 1.7 kilograms of a flocculent mixture containing 170 grains poly(aluminum chloride) mixture and 1530 grams 0.02 molar nitric acid solution was performed. The reactor jacket temperature was set to 57° C. and the particles aggregated to a target size of 4.8 microns as measured with a Coulter Counter. Upon reaching 4.8 microns, an additional 6.896 kilograms of latex was added and the particles grew to the target particle size of 6.00 to 6.10 microns. The particle size was frozen by adjusting the reactor mixture pH to 6.0 with 1 molar sodium hydroxide solution. Thereafter, the reactor mixture was heated at 0.35° C. per minute to a temperature of 85° C., followed by adjusting the reactor mixture pH to 3.95 with 0.3 M nitric acid solution. The reaction mixture was then ramped to 96° C. at 0.35° C. per minute.

At the start of particle coalescence, the ph was tested but not adjusted. The particle shape was monitored by measuring particle circularity using the Sysmex FPIA shape analyzer. Once the target circularity was achieved, for example, 0.953, the ph was adjusted to 7 with 1 percent sodium hydroxide solution. Particle coalescence was continued for a total of 2.5 hours at 96° C. The particles were cooled at a control rate of 0.6° C. per minute to 85° C. and then cooled to 63° C. At 63° C., the slurry was treated with 4 percent sodium hydroxide solution to pH 10 for 60 minutes followed by cooling to room temperature.

The toner of this mixture comprises about 68 percent of styrene/acrylate polymer, about 10 percent of REGAL, 330 pigment, about 12 percent by weight of POLYWAX 725 and about 10 percent by weight of gel polymer.

After removal of the mother liquor, the particles were washed 3 times consisting of one wash with de-ionized water at room temperature, one wash carried out at a pH of 4.0 at 40° C., and finally the last wash with de-ionized water at room temperature. The amount of acid used for the pH 4 wash was 300 grams of 0.3 molar nitric acid. After drying the particles in an Aljet dryer, the final volume median particle size d50=6.18 microns. Surface additives were blended onto the dried particles. The additive package consisted of 2.06 weight percent of RY50 silica from DeGussa/Nippon Aerosil Corporation, which is a silica coated with PDMS (polydimethylsiloxane), 0.37 weight percent of JMT2000 titanium dioxide (manufactured by Tayca) and 0.48 weight percent X24 silica from Shin-Etsu Chemical Co., Ltd., which is a sol-gel silica. The toner was blended with the carrier at the required toner concentration and then evaluated for fusing performance.

Fusing Evaluation

The evaluation of toner fix was carried out in a fusing fixture that used a Teflon on silicon (TOS) fuser roll (comprised of a metal roll coated with an intermediate silicon rubber and overcoated with polytetrafluoroethylene fluoropolymer (Teflon)), 35 Durometer pressure roll and silicone oil on the cleaning web. A paper feeder and paper transport was also part of the fixture. The process speed for this study included fuser process speeds ranged from 596 nun/s to 829 mm/s.

Unfused toner images were generated offline using a modified semi conductive magnetic brush development system (SCMB). The toner mass per unit area was precisely controlled for all the images that were fused, 0.8 mg/cm$^2$ for the control and 0.5 mg/cm$^2$ for the present toner sample. Substrates for the testing were 4200 75 gsm paper used for crease fix testing and a thicker rougher paper (4024 176 gsm) used for the half-tone rub fix testing.

The procedure used for fusing evaluation was to feed 30 plain sheets of paper through the fuser to stabilize the fuser temperature, and then feed the sheet with the unfused sample toner. The temperature of the fuser roll was varied from cold offset up to 210° C. for the two toners and the three process speeds (596, 745, and 829 mm/s).

Crease fix evaluation using standard procedures (print is folded, standard weight rolled over crease (about 960 grams), print is unfolded, creased area wiped with a cotton ball, crease area quantified using an image analysis system) was carried out and the results are summarized in Table 1.

As expected with faster speeds/shorter dwells (with all other fuser items remaining constant, for example, load, nip width and roll durometer) crease fix MFT increases for both toners. At 829 mm/s the comparative toner would require a fuser roll temperature of 209° C. to achieve acceptable crease fix on 4200 paper while the present EA toner could be fused at 187° C.

TABLE 1

Crease-Fix Data for Comparative and Present Toners

| Dwell (ms) | Speed (mm/s) | Pages/min (PPM) | Comparative Toner MFT (° C.) CA = 40 | Present EA Toner MFT (° C.) CA = 40 | ΔMFT (° C.) |
|---|---|---|---|---|---|
| 23.4 | 596 | 144 | 189 | 173 | 16 |
| 18.8 | 745 | 160 | 203 | 184 | 19 |
| 17.0 | 829 | 180 | 209 | 187 | 22 |

CA = Crease Area (Crease Fix)

Standard rub fix procedures were used for the test. The half-tone pattern on the fused print was rubbed using a Taber Linear Abrader to which a crock cloth had been attached. A 500 gram load was used during the test and two cycles of rubbing the pattern. After the physical rubbing of the pattern, the crock cloth was removed from the Taber Linear abrader and the average optical density of the toner that had transferred to the cloth was measured (using a Gretag/Macbeth Transmission Densitometer). New crock cloth sections were used for each data point.

Half-tone rub fix of the two toners as a function of fuser dwell time and process speeds (596 to 829 mm/sec) are shown in Table 2. Half-tone rub fix performance of the present EA toner is lower than the comparative toner, but the advantage is greater at higher process speeds ranging from −5° C. at 596 mm/sec to −24° C. at 829 mm/sec. This was an unexpected result because usually as the print speed increases it becomes more difficult to fuse the toner and subsequently requires lower melting toners as print speeds increase. For the EA toner, half-tone rub fix performance improves at higher print speeds relative to the comparative toner and is almost insensitive to increases in print speeds.

TABLE 2

Half-tone Rub Fix Data for Comparative and Present Toners

| Dwell (ms) | Speed (mm/s) | Pages/min (PPM) | Comparative Toner MFT (° C.) CA = 40 | Present EA Toner MFT (° C.) CA = 40 | ΔMFT (° C.) |
|---|---|---|---|---|---|
| 23.4 | 596 | 144 | 192 | 187 | 5 |
| 18.8 | 745 | 160 | 212 | 192 | 20 |
| 17.0 | 829 | 180 | 218 | 194 | 24 |

It will be appreciated that variations of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims. Unless specifically recited in a claim, steps or components of claims should not be implied or imported from the specification or any other claims as to any particular order, number, position, size, shape, angle, color or material.

What is claimed is:

1. An emulsion aggregation toner having toner particles comprising a gel latex, a high Tg latex having an onset Tg of 53° C. to 55° C., optional colorant, and a wax in an amount of 10 weight percent to 14 weight percent of the toner particles, wherein the toner particles produce an image with a half-tone rub fix property as measured as an optical density of the toner particles rubbed off onto a white cloth of less than 0.12 and a crease fix property of less than 60, when the fusing temperature of the toner particles is from 185° C. to 200° C. at process speeds of from about 560 mm/s to about 870 mm/s, and the toner particles are formed by an emulsion/aggregation process comprising:

forming a mixture comprising the gel latex, the high Tg latex, the optional colorant and the wax, stirring the mixture until homogenized, heating the mixture to an aggregation temperature and maintaining the mixture at the aggregation temperature for a time sufficient to permit aggregation of toner particles to the desired size, heating the toner particles to a coalescence temperature above the Tg temperature of the high Tg latex to allow the toner particles to coalesce, cooling the coalesced toner particles at a controlled rate of about 0.6° C. per minute from the coalescence temperature to 85° C., and after the controlled cooling, allowing the toner particles to cool to room temperature.

2. The toner according to claim 1, wherein a circularity of the toner particles is from about 0.94 to about 1.

3. The toner according to claim 1, wherein D50 of the toner particles is in a range of from about 5.45 to about 6.25 microns.

4. The toner according to claim 1, wherein the gel latex is present in an amount of about 3 weight percent to about 30 weight percent of the toner particles, the high Tg latex is present in an amount of from about 50 weight percent to about 95 weight percent of the toner particles, and the colorant is present in an amount of about 1 weight percent to about 25 weight percent of the toner particles.

5. The toner according to claim 1, wherein the gel latex is present in an amount of about 10 weight percent of the toner particles, the Tg latex is present in an amount of about 68 weight percent of the toner particles, the wax is present in an amount of about 12 weight percent of the toner particles, and the colorant is present in an amount of about 10 weight percent of the toner particles.

6. The toner according to claim 1, further comprising an additive package in an amount of about 1 to about 5 wt % of the toner, the additive package being selected from the group consisting of silica, titanium dioxide and combinations thereof.

7. A developer comprising the toner composition according to claim 1, and a carrier.

8. The developer according to claim 7, wherein the developer is used in a semi conductive magnetic brush development system.

9. A process for forming an image, comprising forming an electrostatic latent image on a photoconductive member, developing the electrostatic latent image to form a visible image by depositing toner on a surface of the photoconductive member, and transferring the visible image to a substrate and fixing the visible image to the substrate with a fuser member, wherein the toner comprises a gel latex, a high Tg latex having an onset Tg of from 53° C. to 55° C., an optional colorant, and a wax in an amount of about 10 weight percent to 14 weight percent of the toner particles, and the toner particles produce an image with a half-tone rub fix property as measured as an optical density of the toner particles rubbed off onto a white cloth of less than 0.12 and a crease fix property of less than 60, when the fusing temperature of the toner particles is from 185° C. to 200° C. at process speeds of from about 560 mm/s to about 870 mm/s, and the toner particles are formed by an emulsion/aggregation process comprising:

forming a mixture of the gel latex, the high Tg latex, the optional colorant and the wax, stirring the mixture until homogenized, heating the mixture to an aggregation temperature and maintaining the mixture at the aggregation temperature for a time sufficient to permit aggregation of toner particles to the desired size, heating the toner particles to a coalescence temperature above the Tg temperature of the high Tg latex to allow the toner particles to coalesce, cooling the coalesced toner particles at a controlled rate of about 0.6° C. per minute from the coalescence temperature to 85° C., and after the controlled cooling, allowing the toner particles to cool to room temperature.

10. The process according to claim 9, wherein the electrostatic latent image is developed with a semi conductive magnetic brush development system.

11. The process according to claim 9, wherein the fuser member comprises a substrate, a silicone rubber coated thereon, and an outer fluoropolymer coated on the silicone rubber.

12. The process according to claim 9, wherein the gel latex is present in an amount of from about 3 weight percent to about 30 weight percent of the toner particles, the high Tg latex is present in an amount of from about 50 weight percent to about 95 weight percent of the toner particles, and the colorant is present in an amount of from about 1 weight percent to about 25 weight percent of the toner particles.

13. The process according to claim 9, wherein the toner comprises about 10% gel latex, about 68% Tg latex, about 10% colorant and about 12% wax.

14. The process according to claim 13, wherein a latitude of the gel latex around about a centerline particle formulation is about 10 weight percent±about 2 weight percent of the toner particles, a latitude of the high Tg latex around about a centerline particle formulation is about 68 weight percent±about 4 weight percent of the toner particles, a latitude of the wax around about a centerline particle formulation is about 12 weight percent±about 2 weight percent of the toner particles, and a latitude of the colorant around about a centerline particle formulation is about 10 weight percent±about 2.0 weight percent of the toner particles.

15. An electrophotographic image forming apparatus comprising:

a photoreceptor, a development system comprising:

a developer comprising a carrier and a toner, the toner comprising toner particles comprising a gel latex, a high Tg latex having an onset Tg of from 53° C. to 55° C., and a wax in an amount of 10 weight percent to 14 weight percent of the toner particles, and a housing in association with the development system wherein the apparatus operates at a fusing temperature of from 185° C. to 200° C. at process speeds of from about 560 mm/s to about 870 mm/s, at which the toner particles exhibit a crease fix property of from less than 60 and a half-tone rub fix property of less than 0.12, and the toner particles are formed by an emulsion/aggregation process comprising:

forming a mixture of the gel latex, the high Tg latex, the optional colorant and the wax, stirring the mixture until homogenized, heating the mixture to an aggregation temperature and maintaining the mixture at the aggregation temperature for a time sufficient to permit aggregation of toner particles to the desired size, heating the toner particles to a coalescence temperature above the Tg temperature of the high Tg latex to allow the toner particles to coalesce, cooling the coalesced toner particles at a controlled rate of about 0.6° C. per minute from the coalescence temperature to 85° C., and after the controlled cooling, allowing the toner particles to cool to room temperature.

16. The electrophotographic image forming apparatus according to claim 15, wherein the fuser member comprises a substrate, a silicone rubber coated thereon, and an outer fluoropolymer coated on the silicone rubber.

17. The electrophotographic image forming apparatus according to claim 15, wherein when the fusing temperature of the toner is from 185° C. to 200° C. at process speeds of about 560 mm/s to about 870 mm/s, the toner image exhibits a crease fix property of less than 40 and a half-tone rub fix property of less than 0.12.

18. The electrophotographic image forming apparatus according to claim 15, wherein the gel latex is present in an amount of from about 3 weight percent to about 30 weight percent of the toner particles, and the high Tg latex is present in an amount of from about 50 weight percent to about 95 weight percent of the toner particles.

19. An emulsion aggregation toner having toner particles comprising:

a gel latex, a high Tg latex having an onset Tg of from 53° C. to 55° C., an optional colorant, and a wax in an amount of 10 weight percent to 14 weight percent of the toner particles, wherein the toner particles produce an image with a half-tone rub fix property as measured as an optical density of the toner particles rubbed off onto a white cloth of less than 0.12 and a crease fix property of less than 40, when the fusing temperature of the toner particles is from 185° C. to 200° C. at process speeds of from about 560 mm/s to about 870 mm/s, and the toner particles are formed by an emulsion/aggregation process comprising:

forming a mixture comprising the gel latex, the high Tg latex, the optional colorant and the wax, stirring the mixture until homogenized, heating the mixture to an aggregation temperature and maintaining the mixture at the aggregation temperature for a time sufficient to permit aggregation of toner particles to the desired size, heating the toner particles to a coalescence temperature above the Tg temperature of the high Tg latex to allow the toner particles to coalesce, cooling the coalesced toner particles at a controlled rate of about 0.6° C. per minute from the coalescence temperature to 85° C., and after the controlled cooling, allowing the toner particles to cool to room temperature.

* * * * *